US008151466B2

(12) United States Patent
Putzer

(10) Patent No.: US 8,151,466 B2
(45) Date of Patent: Apr. 10, 2012

(54) SHAVING APPARATUS WITH A PIVOTABLY MOUNTED SHAVING HEAD

(75) Inventor: Arthur Putzer, Bad Eisenkanppel (AT)

(73) Assignee: Koninklijke Philips Electronic N.V., Eindhoven (NL)

( * ) Notice: Subject to any disclaimer, the term of this patent is extended or adjusted under 35 U.S.C. 154(b) by 1161 days.

(21) Appl. No.: 10/562,536

(22) PCT Filed: Jul. 1, 2004

(86) PCT No.: PCT/IB2004/051092

§ 371 (c)(1),
(2), (4) Date: Dec. 28, 2005

(87) PCT Pub. No.: WO2005/002807

PCT Pub. Date: Jan. 13, 2005

(65) Prior Publication Data

US 2008/0134512 A1 Jun. 12, 2008

(30) Foreign Application Priority Data

Jul. 4, 2003 (EP) ..... 03102018

(51) Int. Cl.
*B26B 19/10* (2006.01)
*B26B 19/04* (2006.01)

(52) U.S. Cl. ..... 30/34.1; 30/41.3; 30/527

(58) Field of Classification Search ..... 30/34.05, 30/34.1, 43.9–43.92, 211, 57, 527–533
See application file for complete search history.

(56) References Cited

U.S. PATENT DOCUMENTS

| | | | | | |
|---|---|---|---|---|---|
| 1,997,096 | A * | 4/1935 | Andis | 30/199 |
| 2,787,053 | A * | 4/1957 | Kleinman | 30/41.6 |
| 3,279,056 | A * | 10/1966 | Andis | 30/34.1 |
| 3,811,188 | A * | 5/1974 | Brenneman et al. | 30/34.05 |
| 4,001,933 | A * | 1/1977 | Czerner | 30/43.92 |
| 4,481,711 | A * | 11/1984 | Pachel et al. | 30/34.1 |
| 4,505,036 | A * | 3/1985 | Ochiai et al. | 30/34.1 |
| 4,581,822 | A * | 4/1986 | Fujimura | 30/216 |
| 4,688,329 | A * | 8/1987 | Oord | 30/43.6 |
| 4,845,847 | A * | 7/1989 | Yasunaka et al. | 30/34.1 |
| 4,922,608 | A | 5/1990 | Pahl | |
| 5,313,704 | A * | 5/1994 | Atsumi et al. | 30/43.6 |
| 5,970,616 | A * | 10/1999 | Wahl et al. | 30/216 |
| 6,505,404 | B2 * | 1/2003 | Ullmann | 30/216 |
| 6,560,875 | B1 | 5/2003 | Eichhorn et al. | |
| 6,789,322 | B2 * | 9/2004 | Iwashita et al. | 30/43.1 |
| 2002/0000043 | A1 * | 1/2002 | Beutel et al. | 30/216 |
| 2002/0162226 | A1 * | 11/2002 | Abraham et al. | 30/210 |
| 2005/0229398 | A1 * | 10/2005 | Leventhal | 30/34.1 |

* cited by examiner

*Primary Examiner* — Laura M. Lee

(57) ABSTRACT

A shaving apparatus includes a base part and a shaving head mounted on the base part. The shaving head is pivotably mounted with respect to the base part about a pivot axis that runs parallel to a longitudinal direction of rows of cutting. The pivot axis is offset towards the base part with respect to the rows of cutting teeth in a depth direction relative to the base part. A spring is provided which spring-loads the shaving head counter to the depth direction away from the base part and towards a rest position of the shaving head.

10 Claims, 2 Drawing Sheets

SHAVING APPARATUS WITH A PIVOTABLY MOUNTED SHAVING HEAD

The invention relates to a shaving apparatus, comprising a base part for being held in one hand and has a top end and a bottom end, and comprising a shaving head being mounted on the base part in the region of the top end of the base part and has a short-hair cutting device and a long-hair cutting device, the long-hair cutting device being arranged next to the short-hair cutting device in a first side direction of the shaving head, and wherein the short-hair cutting device has short-hair cutting parts which interact with one another, and wherein the long-hair cutting device is formed by a toothed cutting device which has two rows of cutting teeth lying next to one another in a longitudinal direction of the rows, and wherein the shaving head is pivotably mounted with respect to the base part, namely about a pivot axis running parallel to the longitudinal direction of the rows.

A shaving apparatus of the type mentioned in the first paragraph is known from U.S. Pat. No. 4,922,608 A. In the known shaving apparatus, the pivot axis about which the shaving head can pivot with respect to the base part lies between the short-hair cutting device and the long-hair cutting device, namely, on the side which in the depth direction of the shaving head faces away from the base part. As a result of this arrangement of the pivot axis, in the known shaving apparatus there must be provided, in the area of the free end of the shaving head, means for the pivotable mounting of the shaving head. The free end area is the area of the shaving head that faces away from the base part. The mounting is achieved in the known shaving apparatus by extending lateral components of the shaving apparatus or shaving head above the level of the short-hair cutting device and the laterally adjacent toothed cutting device. However, this does not provide a pleasant feel upon shaving and is unfavorable in relation to a shaving operation that is as unhindered as possible by the shaving head.

It should furthermore be mentioned that in the known shaving apparatus the pivoting of the shaving head about the pivot axis is brought about only by the friction forces exerted by the skin during operation of the shaving apparatus on the short-hair cutting device and on the toothed cutting device. On account of this, in the case of the known shaving apparatus it may happen that the pivoting of the shaving head is relatively slow and may possibly also take place with too short a stroke, it then not being ensured that both the short-hair cutting device and the toothed cutting device provide as good a cutting result as possible during operation.

It is an object of the invention to eliminate the abovementioned difficulties and provide an improved shaving apparatus.

In order to achieve the abovementioned object, in a shaving apparatus according to the invention there are provided features according to the invention, so that a shaving apparatus according to the invention can be characterized in the following manner, namely:

Shaving apparatus, comprising a base part for being held in one hand and has a top end and a bottom end, and comprising a shaving head being mounted on the base part in the region of the top end of the base part and has a short-hair cutting device and a long-hair cutting device, the long-hair cutting device being arranged next to the short-hair cutting device in a first side direction of the shaving head, and wherein the short-hair cutting device has short-hair cutting parts which interact with one another, and wherein the long-hair cutting device is formed by a toothed cutting device which has two rows of cutting teeth lying next to one another in a longitudinal direction of the rows, and wherein the shaving head is pivotably mounted with respect to the base part, namely about a pivot axis running parallel to the longitudinal direction of the rows, and wherein the pivot axis is arranged offset towards the base part with respect to the short-hair cutting parts and the rows of cutting teeth in a depth direction of the shaving head, and wherein spring means are provided which spring means spring-load the shaving head essentially counter to the depth direction away from the base part and towards a rest position of the shaving head.

By providing the features according to the invention, in a simple and space-saving manner in design terms the situation is achieved whereby for the pivotable mounting of the shaving head there is no need for any pivot mounting means in the area of the free end of the shaving head; rather, the means for the pivotable mounting of the shaving head are arranged offset towards the base part with respect to the free end of the shaving head, so that the means for the pivotable mounting of the shaving head practically do not take up any additional space. Furthermore, by virtue of the inventive arrangement of the pivot axis, the situation is achieved whereby the friction forces exerted on the short-hair cutting device and the toothed cutting device by the skin to be shaved result in a relatively high torque acting on the shaving head, so that a reliable and rapid pivoting of the shaving head is ensured. Furthermore, in the solution according to the invention the advantage is achieved whereby a reliable application or keeping in place of the cutting elements that are to be kept in contact with the skin is ensured by means of the spring means.

In a shaving apparatus according to the invention, a longitudinal axis of the base part and a depth axis of the shaving head may run parallel to one another. In other words, the longitudinal axis and the depth axis may enclose an angle of inclination of 180° with one another. However, a smaller inclination angle may be used which is advantageous with respect to comfortable handling. This is further advantageous with respect to an interaction of the short-hair cutting device and the toothed cutting device with an area of skin to be shaved that is as good and as simultaneous as possible.

In a shaving apparatus according to the invention as mentioned in the previous paragraph, it has proven to be particularly advantageous if the inclination angle lies in a range between 120° and 140° and is preferably about 130°. Such a design has proven advantageous with respect to particularly comfortable handling and particularly effective shaving.

In a shaving apparatus according to the invention, the pivot axis may be arranged approximately in the area of the depth axis of the shaving head. However, it has proven to be particularly advantageous if the pivot axis is arranged offset with respect to the depth axis in the first side direction. As a result, a lever arm which is relevant for the friction forces acting on the cutting devices is achieved with as long a length as possible, and this is advantageous in terms of a pivoting of the shaving head with respect to the base part that is as reliable and rapid as possible.

Known leaf springs, spiral springs or torsion springs may be used as spring means. However, it has proven to be particularly advantageous if a wire spring is additionally provided in a shaving apparatus according to the invention. The wire spring comprises a multiple wound middle section and two leg sections and is arranged with its middle section concentric to the pivot axis. Such a solution is distinguished by a particularly simple structural design and by the simplicity with which the spring means are mounted.

The above-mentioned aspects and further aspects of the invention emerge from the examples of embodiments described below and are explained with reference to these examples of embodiments.

The invention will be further described with reference to examples of embodiments shown in the drawings to which, however, the invention is not restricted.

Figure 1:
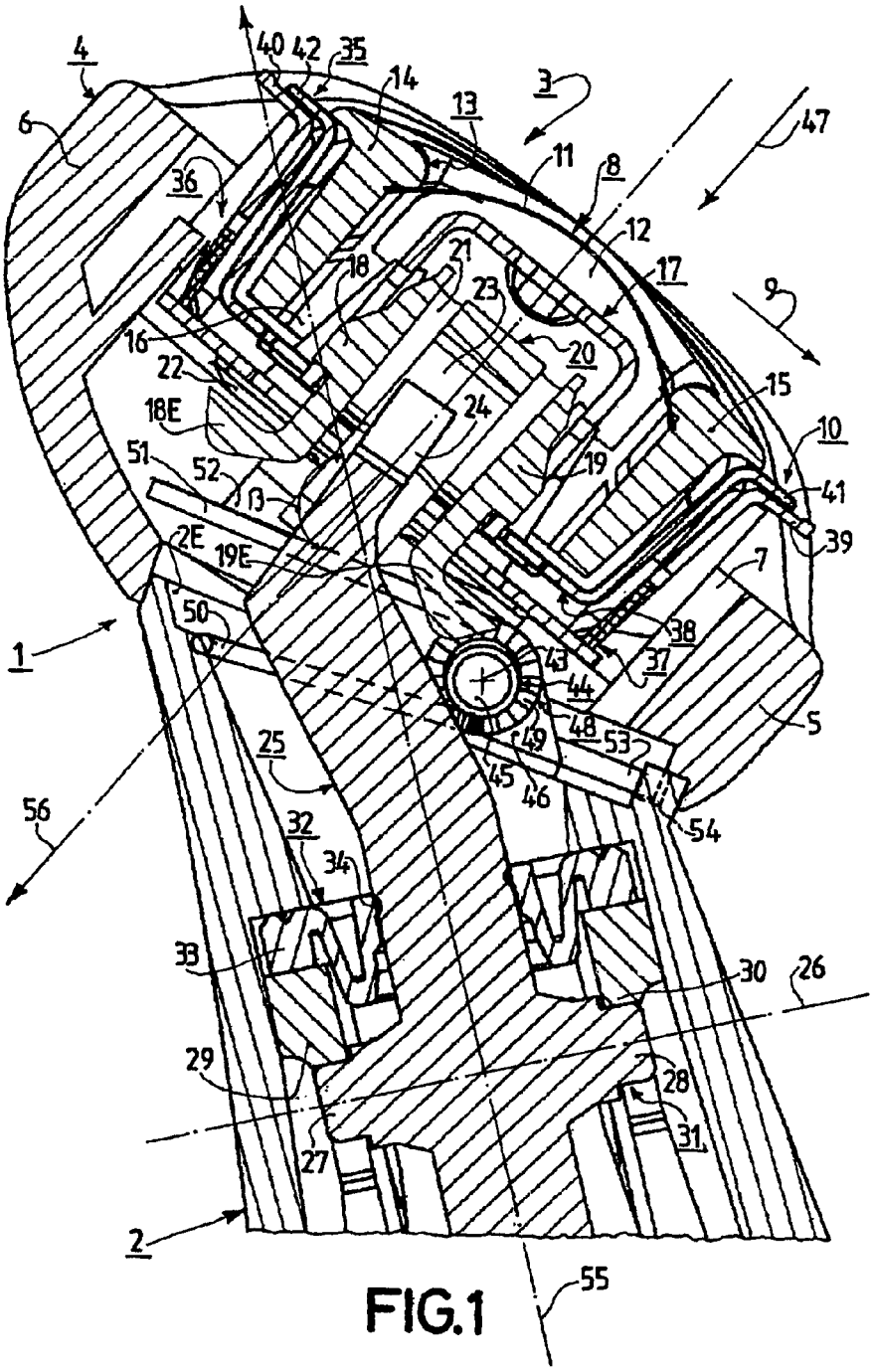
FIG. 1 shows, in section, part of a shaving apparatus according to a first example of embodiment of the invention.

FIG. 1 shows a shaving apparatus 1. The shaving apparatus 1 has a base part 2, which is shown only partially in FIG. 1, and a shaving head 3. The base part 2 can be held in one hand. The base part 2 has a top end 2E and a bottom end which cannot be seen in FIG. 1. Next to the top end 2E, the base part 2 is designed in a neck-like manner compared to the rest of the base part which is not shown in FIG. 1; this means that the base part 2 next to its top end 2E is thin compared to the rest of the base part 2 which cannot be seen in FIG. 1.

The shaving head 3 is mounted on the base part 2 in the region of the top end 2E of the base part 2. The shaving head 3 has a shaving head housing 4 which is designed essentially in the manner of a frame and in this case has a first longitudinal wall 5 and a second longitudinal wall 6 and also two transverse walls 7 which connect the two longitudinal walls 5 and 6 to one another. Only one transverse wall 7 can be seen in FIG. 1. A short-hair cutting device 8 and a long-hair cutting device, which is arranged next to the short-hair cutting device 8 in a first side direction of the shaving head 3 indicated by an arrow 9, are accommodated in the shaving head housing 4, said long-hair cutting device being formed by a first toothed cutting device 10. The short-hair cutting device 8 has short-hair cutting parts 11 and 12 which interact with one another and in the present case are formed by a foil 11 and by a multitude of curved cutting blades 12. The foil 11 is kept in place over the cutting blades 12. The foil 11 is in this case held by a foil frame 13 which comprises two longitudinal bars 14 and 15 and two transverse bars 16, only one transverse bar 16 of said two transverse bars 16 being seen in FIG. 1. The foil frame 13 is fixed in the shaving head housing 4 in a manner not shown in any greater detail here. The cutting blades 12 are held by means of a cutting blade support 17 which is U-shaped in cross section. Two longitudinal bars 18 and 19 of a carrier 20 are connected to the cutting blade support 17. The carrier 20 furthermore has two transverse bars 21, only one transverse bar 21 of said two transverse bars 21 being seen in FIG. 1. From the two longitudinal bars 18 and 19 there project two spring-mounted hooks 18B and 19E, by means of which the carrier 20 and consequently the cutting blade support 17 are secured on a support 22, which is fixed in the shaving head housing 4 in a manner not described in any greater detail, and thus held in the shaving head housing 4. Two carrier ribs 23 are provided inside the carrier 20, only one carrier rib 23 of said two carrier ribs 23 being seen in FIG. 1. The free end 24 of an angled drive lever 25 projects into the carrier 20, namely between the two carrier ribs 23, said drive lever being mounted such that it can pivot about an axis 26 in the base part 2 and having, for its pivotable mounting, two axle stubs 27 and 28 which are held pivotably in thrust bearings 29 and 30 of the base part 2. The axle stubs 27 and 28 and the thrust bearings 29 and 30 form bearing means 31 for the pivotable mounting of the drive lever 25. In the direct vicinity of the bearing means 31, there is provided a seal 32 which is made of elastic material, is fixed by means of a bearing ring 33 in the base part 2 and with a sealing lip 34 surrounds the drive lever 25. The seal 32 ensures a water-tight design of the shaving apparatus 1, so that the parts of the apparatus contained in the base part 2, namely two batteries, an electric motor and an electrical circuit, are well protected against moisture.

A second toothed cutting device 35 is provided in the shaving apparatus 1. The design in this case is such that the short-hair cutting device 8 is arranged between the first toothed cutting device 10 and the second toothed cutting device 35. In the shaving apparatus 1, the first toothed cutting device 10 and the second toothed cutting device 35 are combined to form a toothed cutting configuration 36. The toothed cutting configuration 36 in this case has a first configuration part 37 which is held in a stationary manner in the shaving head 3 and is U-shaped, that is to say trough-shaped, and a second configuration part 38 which is held such that it can be adjusted back and forth with respect to the shaving head 3 and with respect to the configuration part 37 which is held in a stationary manner. The second configuration part 38 is likewise U-shaped, that is to say trough-like, in cross-section. The second configuration part 38 is fixedly connected to the carrier 21 and consequently can be driven back and forth by way of the carrier 21 and with the aid of the drive lever 25.

In the area of each of its two free ends, the first configuration part 37 which is held in a stationary manner has a row of cutting teeth 39 and 40 which runs in a longitudinal direction of the rows. Analogously, the second configuration part 38 has in each case a row of cutting teeth 41 and 42 which runs in the longitudinal direction of the rows. The result of this is that the first toothed cutting device 10 has two rows of cutting teeth 39 and 41 lying next to one another in the longitudinal direction of the rows, said rows being held such that they bear well against one another. Furthermore, the second toothed cutting device 35 has two rows of cutting teeth 40 and 42 lying next to one another in the longitudinal direction of the rows, said rows also being held such that they bear well against one another.

In the shaving apparatus 1, the shaving head 3 is mounted such that it can pivot with respect to the base part 2, namely about a pivot axis 43 that runs parallel to the longitudinal direction of the rows of cutting teeth 39, 40, 41 and 42. The pivot axis 43 is in this case embodied by means of pivot bearing means 44, which pivot bearing means 44 have two bearing stubs 45, of which only one bearing stub 45 can be seen in FIG. 1. The bearing stubs 45 in this case lie inward at a distance from the transverse walls 7 of the shaving head housing 4 and project into bearing holes which are provided in two bearing tabs 46 connected to the base part 2, only one bearing tab 46 of said two bearing tabs 46 being seen in FIG. 1. The pivot axis 43 is in this case arranged—as can clearly be seen in FIG. 1—offset towards the base part 2 with respect to the short-hair cutting parts 11 and 12 and the rows of cutting teeth 39, 40, 41 and 42, in a depth direction of the shaving head 3 that is indicated by an arrow 47. In the present case, the shaving head 3 can be pivoted by about 10° with respect to the base part. However, other solutions in which pivoting by only 5° or by 15°, by 20° or even by more than 20° are also conceivable.

Furthermore, spring means are advantageously provided in the shaving apparatus 1, which spring means spring-load the shaving head 3 essentially counter to the depth direction 47 away from the base part 2 and towards a rest position of the shaving head 3. The spring means comprise a wire spring and are in this case formed by a wire spring 48. The wire spring 48 has a multiple wound middle section 49 and two leg sections 50 and 51. The wire spring 48 is arranged with its middle section 49 concentric to the pivot axis 43 or concentric to the bearing stubs 45. The first leg section 50 bears with its free end on a wall section of the housing of the base part 2. The second leg section 51 bears with an area lying in front of its free end on a stop 52 provided in the shaving head housing 4. The rest position of the shaving head 3, which rest position is shown in FIG. 1, is defined by a limit arm 53 which bears in a recess 54 in the housing of the base part 2 on the bottom wall of this recess 54 to define the rest position of the shaving head 3.

The base part 2 has a longitudinal axis which runs between its bottom end (not shown in FIG. 1) and its top end 4 and is indicated by a dash-dotted arrow 55 in FIG. 1. The shaving head has a depth axis 56 which runs parallel to the depth direction 47 and is likewise indicated by a dash-dotted line in FIG. 1. In the shaving apparatus 1 shown in FIG. 1, the longitudinal axis 55 of the base part 2 and the depth axis 56 of the shaving head 3 enclose an angle of inclination β with one another, said angle of inclination in the present case having a value of about 130°. It is clear that other angles of inclination are also possible, for example 110°, 120°, 140°, 150° or 160°.

In the present case, the pivot axis 43 is arranged offset with respect to the depth axis 56 in the first side direction 9.

Figure 2:
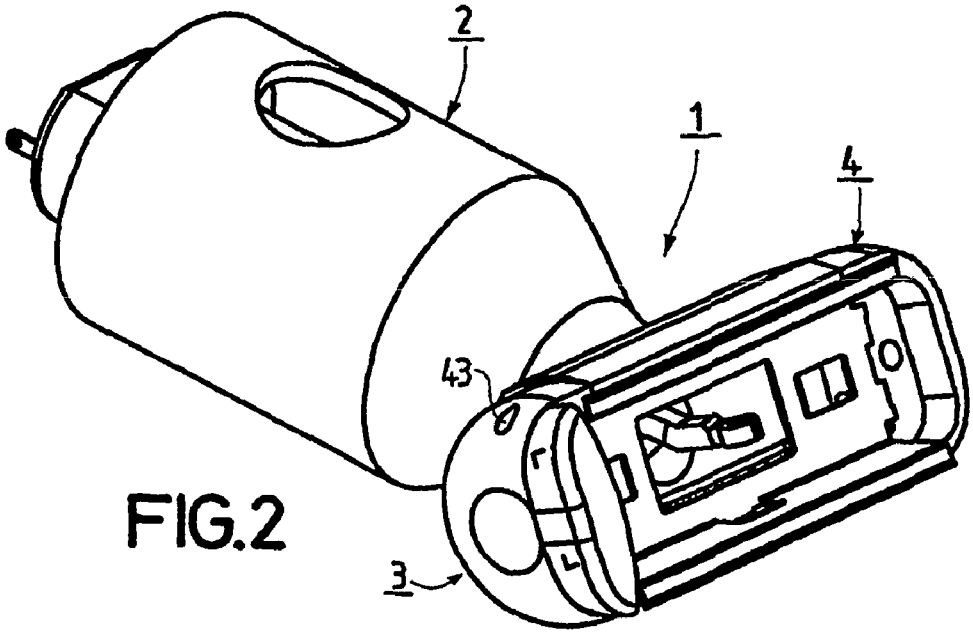
FIG. 2 shows, in an oblique view from above, part of a shaving apparatus according to a second example of embodiment of the invention.
Figure 3:
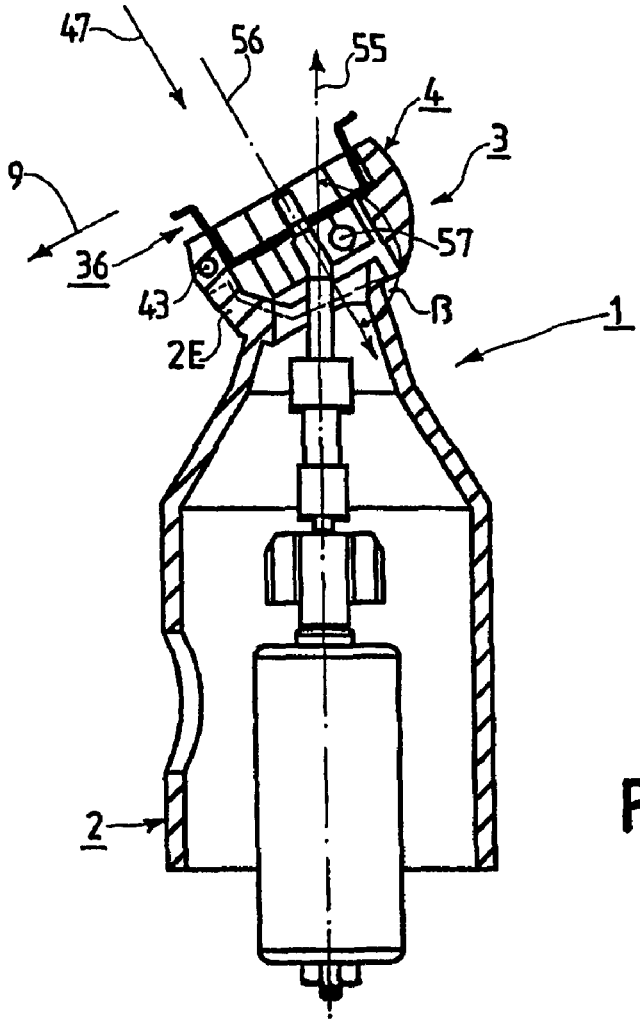
FIG. 3 shows, in section and somewhat schematically, the shaving apparatus of FIG. 2.

In the shaving apparatus 1 shown in FIGS. 2 and 3, the short-hair cutting device is not shown at all and the toothed cutting configuration 36 is shown only schematically.

In the shaving apparatus 1 shown in FIGS. 2 and 3, the pivot axis 43, about which pivot axis 43 the shaving head 3 can be pivoted with respect to the base part 2, is arranged further offset with respect to the depth axis 56 of the shaving head 3 in the first side direction 9 than in the case of the shaving apparatus 1 shown in FIG. 1. In the shaving apparatus 1 shown in FIGS. 2 and 3, the pivot axis lies next to the toothed cutting configuration 36 in the side direction 9, whereas in the shaving apparatus 1 shown in FIG. 1 the pivot axis 43 lies below the toothed cutting configuration 36 in the depth direction 47.

In the shaving apparatus 1 shown in FIGS. 2 and 3, there is provided as spring means a torsion rod spring 57 (shown schematically in FIG. 3), which is held in its middle area in the shaving head 3 and bears with its two end areas on the base part 2 in a manner not shown in any greater detail. By virtue of the torsion rod spring 57, the shaving head 3 is spring-loaded counter to the depth direction 47 away from the base part 2.

In the two shaving apparatuses 1 described above, on account of the design according to the invention the advantage is achieved that, both as the shaving head 3 moves along over a region of skin to be shaved in a movement direction running essentially parallel to the side direction 9, that is to say as the shaving head 3 is being pulled over the area of skin to be shaved, and as the shaving head 3 moves along over a region of skin to be shaved essentially counter to the side direction 9, that is to say as the shaving head 3 is being pushed over the area of skin to be shaved, a good interaction of the short-hair cutting device 8 and of the first toothed cutting device 10 during pulling operation and of the second toothed cutting device 35 during pushing operation is ensured, namely because a relatively high torque is exerted on the shaving head 3 as a result of the friction forces which act on the cutting elements which are in each case in contact with the area of skin to be shaved. This leads to a rapid and faultless pivoting of the shaving head 3 with respect to the base part 2. It is thus ensured, both in the case of pulling operation and in the case of pushing operation, that long hairs are shortened well by the toothed cutting device 10 or 35, which in each case performs its cutting action before the short-hair cutting device 8, and then smooth shaving of the skin is carried out by the short-hair cutting device 8.

The invention is not limited to the solutions described above. A number of solutions are possible both in respect of the arrangement of a pivot axis, about which pivot axis a shaving head can pivot with respect to a base part, and in respect of the design of the means for the pivotable mounting. By way of example, compared to the two solutions described above, in relation to the angled drive lever the pivot axis may also lie on the opposite side of the drive lever. The pivot axis may also be formed by a continuous bearing shaft.

It may furthermore be mentioned that a shaving apparatus according to the invention may also have two short-hair cutting devices, it being possible for both short-hair cutting devices to have for example in each case a stationary upper blade which is U-shaped in cross section and a lower blade which is likewise U-shaped in cross section, is arranged inside the upper blade and can be driven back and forth. It may furthermore be mentioned that a shaving apparatus according to the invention may also have only one short-hair cutting device which may be designed such that at least one annular shaving plate is provided, a number of lower blades which can be driven in rotation interacting with said annular shaving plate. A shaving apparatus according to the invention may also have only one long-hair cutting device.

The invention claimed is:

1. A shaving apparatus comprising:

a base;

a shaving head mounted on the base, the shaving head having a head longitudinal axis along a center of the shaving head in a longitudinal direction of the shaving head;

wherein the shaving head is pivotably mounted with respect to the base about a pivot axis to be pivotally movable during shaving being parallel to the head longitudinal axis and at a side of the shaving head away from a base longitudinal axis of the base, and away from the head longitudinal axis of the shaving head and towards the base, wherein the base longitudinal axis is along a center of the base in a longitudinal direction of the base; and a drive lever extending from the base toward the shaving head along the base longitudinal axis, the drive lever having a free end fixedly attached to the base and extending into the shaving head for driving cutters of the shaving head, wherein the free end is tilted relative the base longitudinal axis by an inclination angle.

2. The shaving apparatus of claim 1, wherein the inclination angle is between 120° and 140°.

3. The shaving apparatus of claim 1, wherein the pivot axis is arranged below the free end towards the base.

4. A shaving apparatus comprising:

a base part for being held in one hand and having a top end and a bottom end;

a shaving head being mounted on the base part in a region of the top end of the base part and having a short-hair cutting device and a long-hair cutting device, the long-hair cutting device being arranged next to the short-hair cutting device in a first side direction of the shaving head, wherein the short-hair cutting device has short-hair cutting parts which interact with one another, and wherein the long-hair cutting device is formed by a toothed cutting device which has two rows of cutting teeth lying next to one another in a longitudinal direction of the rows, and wherein the shaving head is pivotably mounted with respect to the base part about a pivot axis running parallel to the longitudinal direction of the rows to be pivotally movable during shaving, and wherein the pivot axis is arranged offset to a side of the shaving head away from a base longitudinal axis of the base part, and away from a head longitudinal axis of the shaving head and towards the base part with respect to the short-hair cutting parts and the rows of cutting teeth in a depth direction of the shaving head, wherein the base longitudinal axis is along a center of the base part in a longitudinal direction of the base;

a spring that spring-loads the shaving head counter to the depth direction away from the base part and towards a rest position of the shaving head; and a drive lever extending from the base part toward the shaving head along the base longitudinal axis of the base part, the drive lever having a free end fixedly attached to the base part and extending into the shaving head for driving cutters of the shaving head, wherein the free end is tilted relative the base longitudinal axis of the base part by an inclination angle.

5. The shaving apparatus as claimed in claim 4, wherein the longitudinal axis of the base part runs between the bottom end and the top end of the base part, and wherein the central longitudinal axis of the shaving head runs parallel to the depth direction, and wherein the free end is along the central longitudinal axis of the shaving head, and wherein the inclination angle is smaller than 180°.

6. The shaving apparatus as claimed in claim 1, wherein the angle of inclination lies in a range between 120° and 140°.

7. The shaving apparatus as claimed in claim 4, wherein a second toothed cutting device is provided, and wherein the short-hair cutting device is arranged between the two toothed cutting devices.

8. The shaving apparatus as claimed in claim 4, wherein the spring comprises a wire spring which has a multiple wound middle section and two leg sections and is arranged with its middle section concentric to the pivot axis.

9. The shaving apparatus of claim 4, wherein the angle of inclination is about 130°.

10. The shaving apparatus of claim 4, wherein the pivot axis is arranged below the free end towards the base part.

* * * * *